US010100718B2

(12) United States Patent
Thoelking

(10) Patent No.: US 10,100,718 B2
(45) Date of Patent: Oct. 16, 2018

(54) TWO-STROKE ENGINE AND PRODUCTION SERIES OF TWO-STROKE ENGINES

(71) Applicant: Andreas Stihl AG & Co. KG, Waiblingen (DE)

(72) Inventor: Hannah Thoelking, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 63 days.

(21) Appl. No.: 15/299,340

(22) Filed: Oct. 20, 2016

(65) Prior Publication Data

US 2017/0107895 A1 Apr. 20, 2017

(30) Foreign Application Priority Data

Oct. 20, 2015 (DE) ..... 10 2015 013 785

(51) Int. Cl.

| | |
|---|---|
| ***F02B 25/00*** | (2006.01) |
| ***F02B 33/04*** | (2006.01) |
| ***F02B 75/02*** | (2006.01) |
| *F02F 7/00* | (2006.01) |

(52) U.S. Cl.

CPC ..... *F02B 33/04* (2013.01); *F02B 75/02* (2013.01); *F02B 25/00* (2013.01); *F02B 2075/025* (2013.01); *F02F 7/0053* (2013.01)

(58) Field of Classification Search

CPC .... F02B 33/04; F02B 75/02; F02B 2075/025; F02B 25/00; F02F 7/0053

USPC ..... 123/73 R, 73 BA, 73 DA, 73 PP

See application file for complete search history.

(56) References Cited

U.S. PATENT DOCUMENTS

| | | | | |
|---|---|---|---|---|
| 3,695,240 | A * | 10/1972 | Cookson | F02B 25/00 123/193.2 |
| 6,851,402 | B2 * | 2/2005 | Rosskamp | F02B 25/14 123/65 P |
| 8,919,305 | B2 * | 12/2014 | Volckart | F02B 25/14 123/65 R |
| 9,175,598 | B2 | 11/2015 | Geyer et al. | |
| 2005/0045123 | A1 * | 3/2005 | Klaric | F01L 3/205 123/73 A |
| 2012/0304973 | A1 * | 12/2012 | Geyer | F02F 3/24 123/73 R |

* cited by examiner

*Primary Examiner* — Syed O Hasan
(74) *Attorney, Agent, or Firm* — Walter Ottesen, P.A.

(57) ABSTRACT

A two-stroke engine has a cylinder and a transfer channel which, in the region at bottom dead center of a piston, establishes a flow connection between a crankcase interior and the combustion chamber. The crankcase has a crankcase connecting flange for connecting to the cylinder, which has a first connecting opening and a second connecting opening. The transfer channel passes into the crankcase at the first connecting opening or the second connecting opening. At the other of the first and second connecting openings, no transfer channel passes into the crankcase. For a production series of two-stroke engines, provision is made, in one two-stroke engine of the series, which has a first cylinder, for a second connecting opening to be closed off from the cylinder, and, in one two-stroke engine of the series, which has a second cylinder, for the first connecting opening to be closed off by the cylinder.

13 Claims, 4 Drawing Sheets

TWO-STROKE ENGINE AND PRODUCTION SERIES OF TWO-STROKE ENGINES

CROSS REFERENCE TO RELATED APPLICATION

This application claims priority of German patent application no. 10 2015 013 785.9, filed Oct. 20, 2015, the entire content of which is incorporated herein by reference.

BACKGROUND OF THE INVENTION

U.S. Pat. No. 6,851,402 discloses a two-stroke engine, the transfer channels of which are guided parallel to the cylinder longitudinal axis in the cylinder. U.S. Pat. No. 9,175,598 shows a two-stroke engine in which the transfer channels are guided helically around the cylinder bore and lead into the crankcase interior under the inlet opening and/or under the outlet opening. A section of the transfer channels which connects the passage opening of the transfer channel at the cylinder flange to the mouth opening into the crankcase is guided in the crankcase. On account of the different arrangement of the passage openings at the cylinder connecting flange, crankcases of different configurations are required for cylinders having straight transfer channels and for cylinders having transfer channels that extend helically around the cylinder bore.

SUMMARY OF THE INVENTION

The invention is based on the object of making the production and storage of a two-stroke engine easier. A further object of the invention is to create a production series of two-stroke engines which allows easy production and storage.

For the two-stroke engine, provision is made for at least one first connecting opening and at least one second connecting opening to be provided on the connecting flange of the crankcase. The two connecting openings are in this case arranged radially outside the cylinder bore with regard to the cylinder longitudinal axis. At the at least one first connecting opening or the at least one second connecting opening, the at least one transfer channel passes into the crankcase. At the other of the first and second connecting openings, no transfer channel passes into the crankcase interior. Accordingly, provision can be made for the transfer channel to pass into the crankcase at the at least one first connecting opening and for no transfer channel to pass into the crankcase interior at the at least one second connecting opening, or for the at least one transfer channel to pass into the crankcase at the at least one second connecting opening and for no transfer channel to pass into the crankcase interior at the at least one first connecting opening. The connecting opening at which no transfer channel passes into the crankcase interior is a blind opening which does not establish any connection to a transfer channel section in the cylinder and thus does not establish any connection to the combustion chamber at bottom dead center of the piston. This connecting opening does not have any function for this two-stroke engine. If another type of cylinder is arranged on this type of crankcase, the connection into the combustion chamber is advantageously established at the other of the connecting openings. Accordingly, depending on the type of cylinder, the at least one first connecting opening or the at least one second connecting opening is separated from the combustion chamber by the cylinder in every position of the piston.

The two-stroke engine is advantageously divisible into four sectors that extend parallel to the cylinder longitudinal axis, wherein a first sector contains at least one transfer window of a transfer channel and a second sector contains the outlet opening. The at least one first connecting opening is advantageously arranged in the first sector, in which at least one transfer window of a transfer channel is also arranged. The at least one first connecting opening serves to connect to at least one transfer channel section of a cylinder, which passes into the crankcase in the first sector and is advantageously guided approximately parallel to the cylinder longitudinal axis. The at least one second connecting opening is advantageously arranged in the second sector. The at least one second connecting opening serves to connect to at least one transfer channel section which leads into the crankcase in the second sector, that is, under the outlet, and is advantageously guided helically around the cylinder bore. However, the second connecting opening can also serve to connect to at least one transfer channel which is guided parallel to the cylinder longitudinal axis in the cylinder and which is guided into the second sector in the cylinder connecting flange or in the partition plane between the cylinder and crankcase.

Advantageously, the through-opening in the crankcase connecting flange is connected to at least one first connecting opening. The at least one first connecting opening and the through-opening are accordingly located one above the other in the crankcase connecting flange. The at least one first connecting opening is advantageously formed at a recess in the crankcase connecting flange, the recess being open with respect to the crankcase interior over its entire height. As a result, the at least one first connecting opening can be produced easily, in particular during the production of the crankcase in a casting process. Advantageously, the second connecting opening is separated from the through-opening by a crosspiece and is connected to the crankcase interior via a channel section. However, provision can also be made for at least one second connecting opening to be connected to the through-opening and for the at least one second connecting opening to be formed at a recess in the crankcase connecting flange, the recess being open with respect to the crankcase interior over its entire height. The arrangement of a crosspiece between a first connecting opening and a through-opening and the connection of the at least one first connecting opening to the crankcase interior via a channel that is guided in the wall of the crankcase and is closed off with respect to the crankcase interior on a longitudinal side can also be advantageous.

The two-stroke engine advantageously has a central plane which contains the cylinder longitudinal axis and is arranged perpendicularly to the crankshaft rotational axis. Advantageously, at least two transfer channels are provided, the transfer windows of which are arranged on opposite sides of the central plane and which extend symmetrically to the central plane. Four transfer channels that are arranged symmetrically to the central plane are considered to be particularly advantageous. Preferably, precisely one second connecting opening is provided, which is intersected by the central plane. Since precisely one connecting opening is provided, the production of the crankcase in a casting process is made easier. Provision can also be made for transfer channels extending adjacently to one another in the first sector to pass into the crankcase via a common first connecting opening. This also results in easier production.

The crankcase advantageously comprises a first crankcase component and a second crankcase component which are connected together at a partition plane extending parallel to the central plane. The partition plane is advantageously at a spacing from the central plane. Two transfer windows are advantageously arranged in the first sector. The width, measured parallel to the central plane, of the first connecting opening is advantageously at least 1.5 times the width of a transfer window. Advantageously, the width of the first connecting opening is selected such that the circumferentially external longitudinal sides, facing away from the other transfer channel in each case, of the transfer channels terminate flush with the associated sides of the connecting opening.

The crankshaft is advantageously mounted in the crankcase on a first and a second crankshaft bearing. Between the two crankshaft bearings, the connecting rod is advantageously mounted on the crankshaft. The crankshaft bearings are at a spacing from one another that is measured parallel to the crankshaft rotational axis, wherein the width, measured parallel to the crankshaft rotational axis, of the second connecting opening is advantageously smaller than the spacing of the crankshaft bearings. The second connecting opening is accordingly comparatively narrow. This allows a small overall width of the cylinder. It is only at the cylinder connecting flange that the cylinder has to be sufficiently wide to close the at least one first connecting opening.

For a series of two-stroke engines which comprises at least one first cylinder, at least one second cylinder and at least one crankcase which can be mounted on the first or the second cylinder, wherein each cylinder has a cylinder bore, wherein the first cylinder has at least one transfer channel section which leads out at a first transfer opening at the cylinder connecting flange and at a transfer window at the cylinder bore, wherein the second cylinder has at least one transfer channel section which leads out at a second transfer opening at the cylinder connecting flange and at a transfer window at the cylinder bore, wherein the crankcase has a crankcase connecting flange, wherein the crankcase connecting flange has at least one first connecting opening for connecting to a first transfer opening of the first cylinder and at least one second connecting opening for connecting to a second transfer opening of the second cylinder, wherein the first connecting opening and the second connecting opening are arranged radially outside the cylinder bore with regard to the cylinder longitudinal axis, provision is made, in one two-strike engine of the series, which has a first cylinder, for the second connecting opening to be closed off from the cylinder, and, in one two-stroke engine of the series, which has a second cylinder, for the first connecting opening to be closed off from the cylinder. Since the connecting opening which is not required for the cylinder mounted on the crankcase is closed off from the cylinder in each case, a crankcase can be used both for first and for second cylinders. As a result, only one type of crankcase has to be produced and stored, thereby making production and storage easier.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
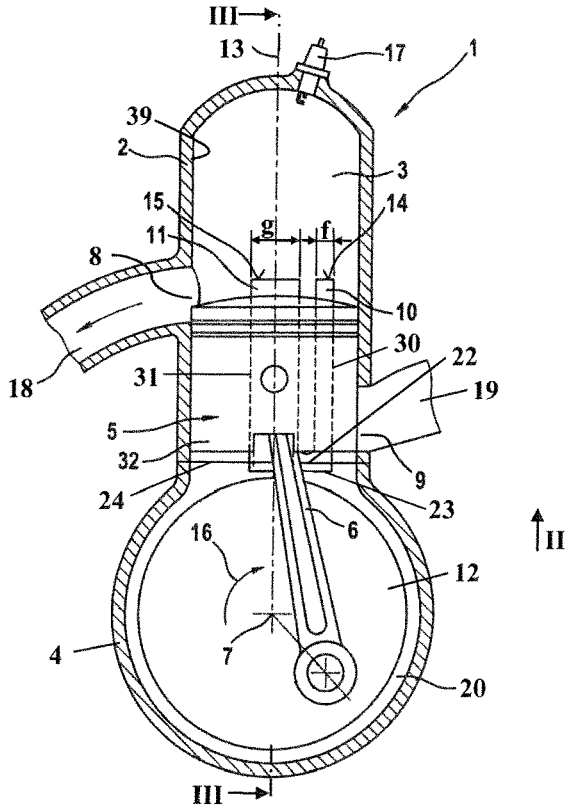
FIG. 1 shows a schematic sectional illustration of a two-stroke engine.

FIG. 1 schematically shows a two-stroke engine 1. The two-stroke engine 1 comprises a cylinder 2 in which a cylinder bore 39 is formed. An inlet channel 19 having an outlet opening 9 and an outlet channel 18 having an outlet opening 8 lead out at the cylinder bore 39. A piston 5 is mounted in the cylinder bore 39 in a reciprocating manner in the direction of a cylinder longitudinal axis 13. The piston 5 drives, via a connecting rod 6, a crankshaft 12 mounted rotatably in a crankcase interior 20 of a crankcase 4. The crankshaft 12 is schematically shown in FIG. 1 and is mounted so as to rotate in a rotational direction 16 about a crankshaft rotational axis 7. Transfer channels 10 close to the inlet and transfer channels 11 close to the outlet are formed in the cylinder 2 and in the crankcase 4. In the embodiment, two transfer channels 10 close to the inlet and two transfer channels 11 close to the outlet are arranged symmetrically with respect to the section plane in FIG. 1. The transfer channels 10 lead into the combustion chamber 3 by way of transfer windows 14 and the transfer channels 11 close to the outlet lead into the combustion chamber 3 by way of transfer windows 15 close to the outlet. The transfer windows 14 and 15, and also the outlet opening 8 and the inlet opening 9, are controlled by a piston skirt 32 of the piston 5. The piston 5 delimits a combustion chamber 3 formed in the cylinder 2. A spark plug 17 projects into the combustion chamber 3.

As FIG. 1 schematically shows, a transfer channel section 30 of the transfer channel 10 close to the inlet and a transfer channel section 31 of the transfer channel 11 close to the outlet are formed in the cylinder 2. The cylinder 2 is connected to the crankcase 4 at a partition plane 24. Advantageously, a seal is arranged between the cylinder 2 and the crankcase 4 at the partition plane 24. The transfer channels 10 and 11 are connected together next to the partition plane 24 in the cylinder 2 and pass into the crankcase 4 at a common transfer opening 22. In this case, the transfer channels 10 and 11 arranged on one side of the cylinder 2 are connected together in each case. Formed in the crankcase 4 is an outlet opening 23 at which the transfer channels 10 and 11 lead into the crankcase interior 20.

As FIG. 1 shows, the transfer windows 14 close to the inlet have a width (f) measured in the cylinder circumferential direction and the transfer windows 15 close to the outlet have a width (g). In the embodiment, the width (g) is greater than the width (f). However, identical widths (f, g) of the transfer windows (14, 15) or a width (g) which is less than the width (f) can also be advantageous.

As FIG. 1 shows, the transfer channels 10 and 11 are guided approximately parallel to the cylinder longitudinal axis 13 in the cylinder. The transfer channels (10, 11) are open toward the cylinder bore 39 in the embodiment. However, provision can also be made for the transfer channels 10 and 11 to be closed off with respect to the cylinder bore 39 along a section of their length.

Figure 2:
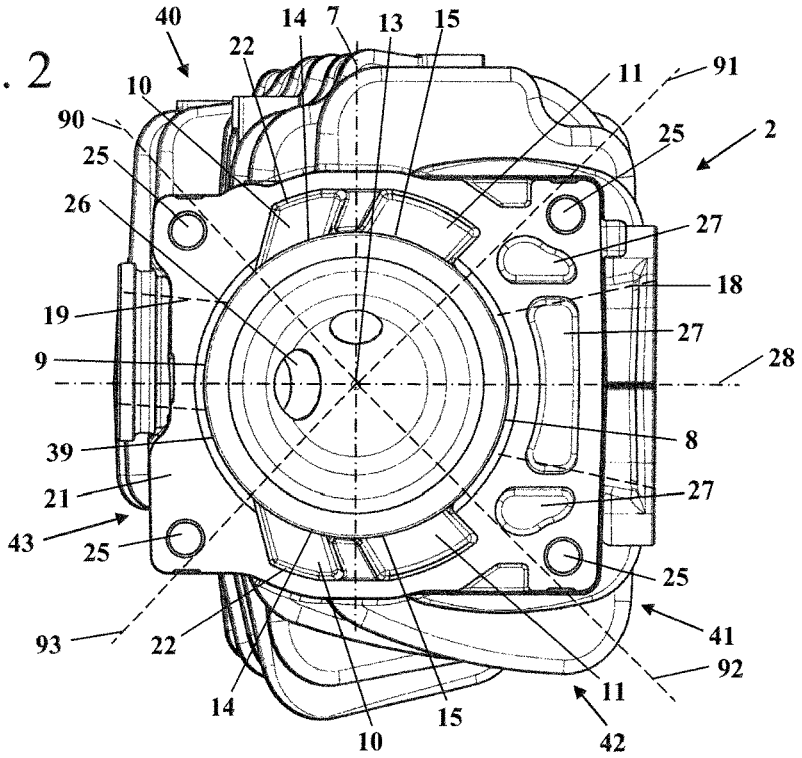
FIG. 2 shows a view of the cylinder of the two-stroke engine from FIG. 1 in the direction of the arrow II in FIG. 1.

FIG. 2 shows a view of the cylinder 2 from below, that is, from the side facing the crankcase 4. Also visible in FIG. 2 is the opening 26 in the cylinder 2, through which the spark plug 17 (FIG. 1) projects. On its side facing the crankcase 4, the cylinder 2 has a cylinder connecting flange 21 at which the two transfer openings 22 lead out. The transfer openings 22, and also the transfer channels 10 and 11, are arranged radially outside the cylinder bore 39 with regard to the cylinder longitudinal axis 13. As FIG. 2 shows, the cylinder 2 has a central plane 28. The central plane 28 contains the cylinder longitudinal axis 13 and is oriented perpendicularly to the rotational axis 7 of the crankshaft 12. The central plane 28 corresponds to the plane of symmetry of the transfer channels 10 and 11. The transfer openings 22 are also arranged symmetrically with respect to the central plane 28. The cylinder 2 is placed on the crankcase 4 by way of the cylinder connecting flange 21.

In the embodiment, the cylinder connecting flange 21 has four fastening openings 25 through which the cylinder 2 is screwed tightly to the crankcase 4 by way of fastening screws. As FIG. 2 schematically shows, the outlet opening 8 and the inlet opening 9 are arranged in the region of the central plane 28 and are intersected by the central plane 28. In the embodiment, the inlet opening 9 is not arranged symmetrically with respect to the central plane 28 but is offset slightly with respect to the central plane 28. The outlet opening 8 is arranged symmetrically with respect to the central plane 28. As FIG. 2 also shows, the cylinder connecting flange 21 has recesses 27 which serve to save weight. The recesses 27 do not have any further function for the two-stroke engine 1, however.

The transfer openings 22 and the inlet opening 9 and outlet opening 8 are each arranged approximately opposite one another with regard to the cylinder bore 39. The cylinder 2 is divisible into four sectors 40, 41, 42 and 43, wherein the sectors 40 to 43 each extend outward from the cylinder longitudinal axis 13 like pieces of pie. The sectors 40 and 43 are separated by an imaginary plane 90 which projects outward radially from the cylinder longitudinal axis 13 with respect to the cylinder longitudinal axis 13. The sectors 40 and 41 are separated by an imaginary plane 91, the sectors 41 and 42 by an imaginary plane 92, and the sectors 42 and 43 by an imaginary plane 93. The imaginary planes 91 to 93 also project radially outward from the cylinder longitudinal axis 13. In this case, the planes 90 and 92 and the planes 91 and 93 can each be located in a common plane or enclose an angle of less than 180° with one another. Two transfer channels 10 and 11 and the associated transfer opening 22 are arranged in the first sector 40. The associated transfer windows 14 and 15 are also arranged entirely in the first sector 40. The outlet opening 8 and the outlet channel 18 are arranged in the second sector 41. The transfer channels 10 and 11 arranged opposite the first sector 40 together with their transfer windows 14 and 15 and the associated transfer opening 22 are arranged entirely in the third sector 42. The inlet opening 9 is arranged in the fourth sector 43. In the embodiment, the inlet channel 19 also extends entirely in the fourth sector 43. The sectors 40 to 43 are accordingly selected such that two transfer channels (10, 11), the outlet opening 8 or the inlet opening 9 are arranged entirely in the respective sector 40 to 43. Depending on the circumferential spacing between the transfer channels (10, 11) and the inlet opening 9 and the outlet opening 8, several positions for the planes 90 to 93 are possible.

Figure 3:
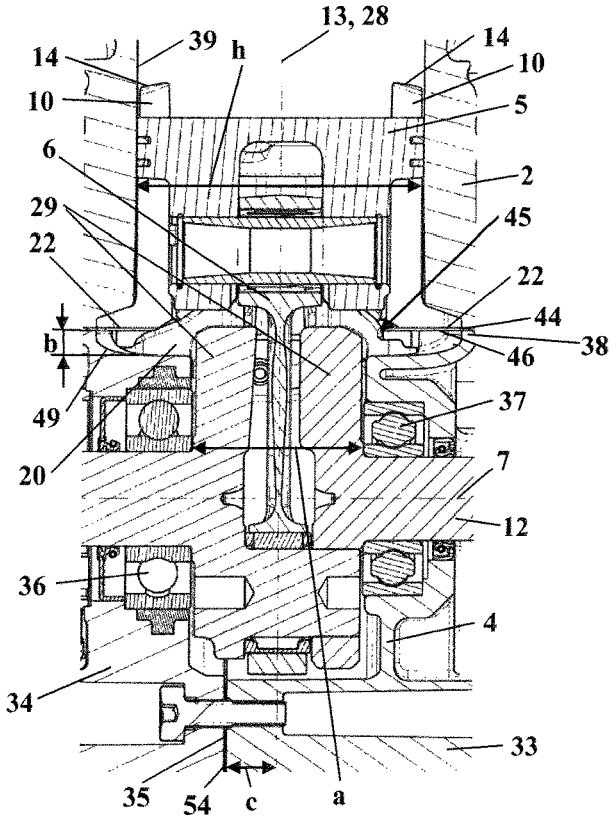
FIG. 3 shows a sectional illustration through a detail of the two-stroke engine along the line III-III in FIG. 1.

FIG. 3 shows a section through the two-stroke engine 1. The section shown in FIG. 3 extends between the transfer channels 10 and 11. The transfer channels 10 and 11 are visible in the section in the region adjoining the transfer opening 22, in which the transfer channels 10 and 11 are connected together. As FIG. 3 shows, the transfer channels 10 lead out with their transfer windows 14 behind the section plane shown, while the transfer channels 11 are located with their transfer windows 15 in front of the section plane and are not shown. The crankcase 4 has a crankcase connecting flange 38 at which the cylinder 2 is arranged. Advantageously, a seal 44 (see FIG. 3) is arranged between the cylinder connecting flange 71 and the crankcase connecting flange 38.

As FIG. 3 also shows, the crankshaft 12 is rotatably mounted by way of two crankshaft bearings 36 and 37. On both sides of the connecting rod 6, the crankshaft 12 has in each case a crank web 29. The crankshaft bearings 36 and 37 are arranged on that side of the crank web 29 that faces in each case away from the connecting rod 6. The crankshaft bearings 36 and 37 are at a spacing (a) from one another that is measured parallel to the rotational axis 7 of the crankshaft 12. The spacing (a) is less than a diameter (h) of the cylinder bore 39. As FIG. 3 shows, the crankcase 4 has a connecting opening 46 which adjoins the transfer opening 22 and through which the transfer channels 10 and 11 pass into the crankcase 4. On the side facing the cylinder 2, the crankcase 4 has recesses 49 which adjoin the connecting openings 46. The connecting openings 49 are open toward the crankcase interior 20 over their entire height (b) measured parallel to the cylinder longitudinal axis 13. However, provision can also be made for channels rather than the recesses 49 to be formed in the crankcase 4, the channels connecting the connecting opening 46 to the crankcase interior 20.

The crankcase 4 is made up of two crankcase components 33 and 34 which are connected together at a partition plane 35. A seal 54 is advantageously arranged between the crankcase components 33 and 34 at the partition plane 35. The partition plane 35 between the crankcase components 33 and 34 extends parallel to the central plane 28. In the embodiment, the partition plane 35 is at a spacing (c) from the central plane 28. The spacing (c) is advantageously less than half the spacing (a) between the crankshaft bearings 36 and 37. As a result, the partition plane 35 extends between the crankshaft bearings 36 and 37. However, the partition plane 35 can also coincide with the central plane 28 of the cylinder 2.

Figure 4:
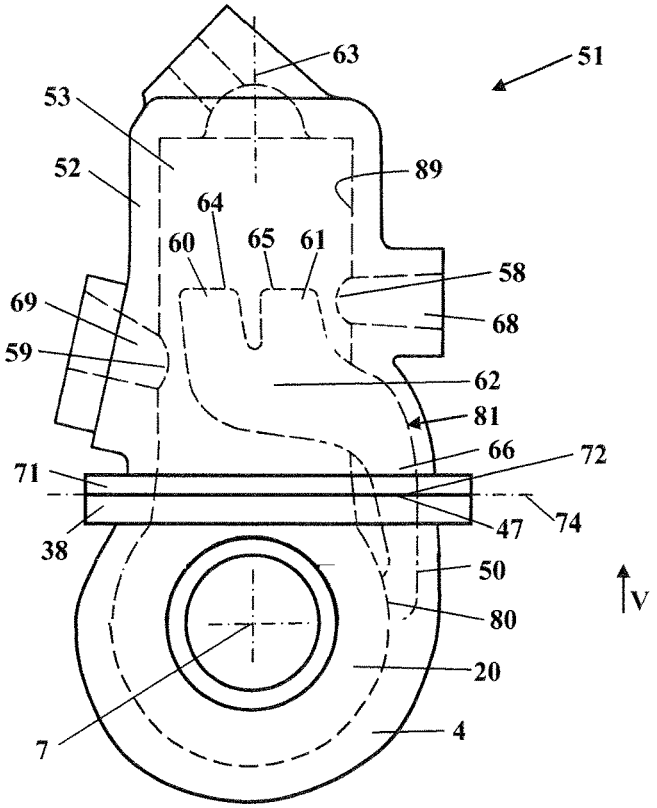
FIG. 4 shows a schematic side view of an embodiment of a two-stroke engine.
Figure 5:
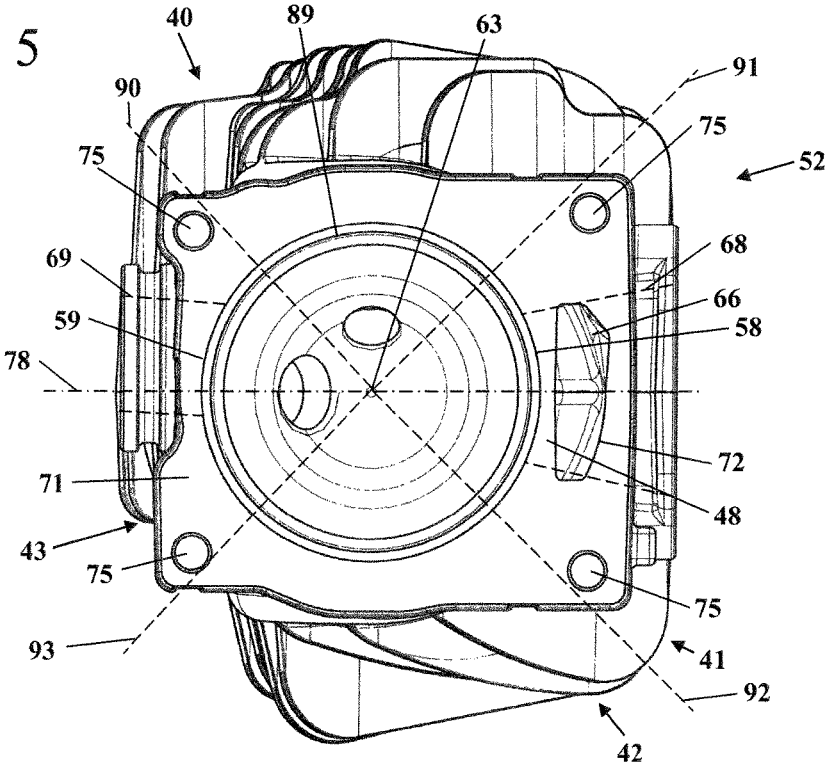
FIG. 5 shows a view of the cylinder of the two-stroke engine from FIG. 4 in the direction of the arrow V in FIG. 4.

FIG. 4 schematically shows a two-stroke engine 51 which belongs to the same series as the two-stroke engine 1. The two-stroke engine 51 has a cylinder 52, the structure of which differs fundamentally from the cylinder 2. The cylinder 52 is placed on a crankcase 4 which is structurally identical to the crankcase 4 of the two-stroke engine 1. Accordingly, the crankcase 4 can be assembled with a cylinder 2 to form a two-stroke engine 1 or with a cylinder 52 to form a two-stroke engine 51. The two-stroke engine 51 has transfer channels 60 close to the inlet and transfer channels 61 close to the outlet. The transfer channels 60 close to the inlet lead into a combustion chamber 53 by way of transfer windows 64 and the transfer channels 61 close to the outlet lead into the combustion chamber 53 by way of transfer windows 65. In each case two transfer channels 60 and 61 are arranged symmetrically with respect to a central plane 78 (FIG. 5). The combustion chamber 53 is formed in a cylinder bore 89. The piston 5 delimiting the combustion chamber 53 is not shown in FIG. 4. The piston 5 is formed in a manner corresponding to the piston 5 of the two-stroke engine 1. The further structure of the two-stroke engine 51, which is not shown in detail in FIG. 4, also corresponds to that of the two-stroke engine 1.

The transfer channels 60 and 61 which are arranged adjacent to one another at the cylinder circumference on one side of the central plane 78 are combined in the cylinder 51 in a common section 62 in the direction of flow toward the crankcase interior 20. The common section 62 is guided helically or spirally around the cylinder bore 89 as far as the region under an outlet opening 58 of the cylinder 52. The region under the outlet opening 58 is in this case that side of the outlet opening 58 that faces the crankcase 4. The two sections 62 of the transfer channels 60 and 61 guided on opposite sides of the central plane 78 are combined into a common section 66 in the region under the outlet opening 58 and pass jointly into the crankcase 4 at a connecting flange 71 of the cylinder 52. Formed in the crankcase 4 is a channel section 50 through which the transfer channels 60 and 61 are guided and which leads into the crankcase interior 20 by way of an outlet opening 80. A transfer channel section 81 is guided in the cylinder 52, the transfer channel section 81 being made up of the common section 66, the two common sections 62 and those sections of the transfer channels 60 and 61 that lead to the transfer windows 64 and 65.

The cylinder 52 has a cylinder longitudinal axis 63. An inlet channel 69 leads out at the cylinder bore 89 by way of an inlet opening 59. The outlet opening 58 is adjoined by an outlet channel 68 through which exhaust gases can leave the combustion chamber 53. The outlet opening 58 and the inlet opening 59 are controlled by the piston skirt 32 of the piston 5 (FIG. 1). The crankcase 4 has a crankcase connecting flange 38 on which the cylinder connecting flange 71 is placed. The transfer channel section 81 in the cylinder 52 leads out at the cylinder connecting flange 71 by way of a transfer opening 72. The channel section 50 adjoins the transfer opening 72 by way of a connecting opening 47. The cylinder connecting flange 71 bears against the crankcase connecting flange 38 at a partition plane 74.

FIG. 5 shows the cylinder 52 in detail. The cylinder 52 is also divisible into four sectors (40, 41, 42, 43) which adjoin one another at the imaginary planes (90, 91, 92, 93). In each case two transfer windows (64, 65) (FIG. 4) arranged on one side of the central plane 78 are arranged in the sectors 40 and 42. The outlet opening 58 and also, in the embodiment, the outlet channel 68 adjoining the outlet opening 58 are entirely arranged in the second sector 41. The inlet opening 59 and also, in the embodiment, the inlet channel 69 adjoining the inlet opening 59 are entirely arranged in the fourth sector 43.

As FIG. 5 shows, the transfer opening 72 is entirely arranged in the second sector 41. The common section 66 of the transfer channels 60 and 61 is also entirely arranged in the second sector 41 in the embodiment. The transfer channels 60 and 61 pass into the adjacent sectors 40 and 42 by way of their common sections 62 only at a distance from the plane of the connecting flange 71. No opening is provided at the cylinder connecting flange 71 outside the cylinder bore 89 in the sectors 40 and 42. The cylinder connecting flange 71 has four fastening openings 75 which are arranged in the sectors 41 and 43 in the embodiment. However, provision can also be made for the fastening openings 75 to be arranged partially or entirely in the sectors 40 and 42.

Figure 6:
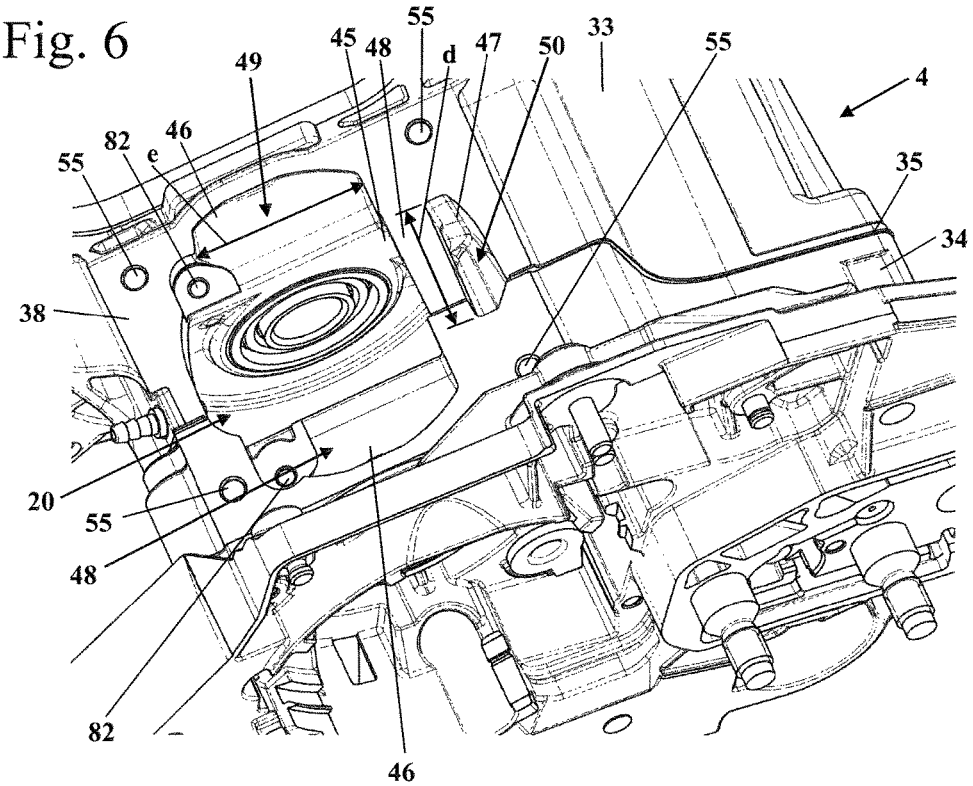
FIG. 6 shows a perspective illustration of the crankcase of the two-stroke engines from FIGS. 1 and 4; and, FIG. 7 shows a sectional illustration of a detail of the two-stroke engine from FIG. 1.

FIG. 6 shows the crankcase 4 in detail. The crankcase connecting flange 38 has a through-opening 45 which leads into the crankcase interior 20 and through which the connecting rod 6 projects. At bottom dead center of the piston 5, the crank webs 29 can also be partially arranged in the through-opening 45. Arranged outside the cylinder bore (39, 89) are the two connecting openings 46, which are formed at recesses 49 and which are open toward the crankcase interior 20. At the crankcase connecting flange 38, the through-opening 45 and the two connecting openings 46 are connected together and form a common opening which extends radially outward beyond the cylinder bore (39, 89) with regard to the cylinder longitudinal axis (13, 63). The connecting openings 46 have a width (e) measured parallel to the central plane 28 (FIG. 2). The width (e) is at least 1.5 times the width (f, g) of a transfer window (14, 15, 64, 65). The width (f, g), measured in the circumferential direction, of the transfer windows 64 and 65 can correspond to that of the transfer windows 14 and 15. In the embodiment, the transfer windows 64 and 65 are the same width (f, g). Advantageously, the width (e) of the connecting opening 46 corresponds to the sum of the width (f) and the width (g) of the transfer windows 14 and 15 and to the width of the intermediate space formed between the transfer windows 14 and 15. The connecting openings 46 are arranged in the first sector 40 and the third sector 42 and are arranged symmetrically with respect to the central plane 28 (FIG. 2) in the embodiment.

Figure 7:
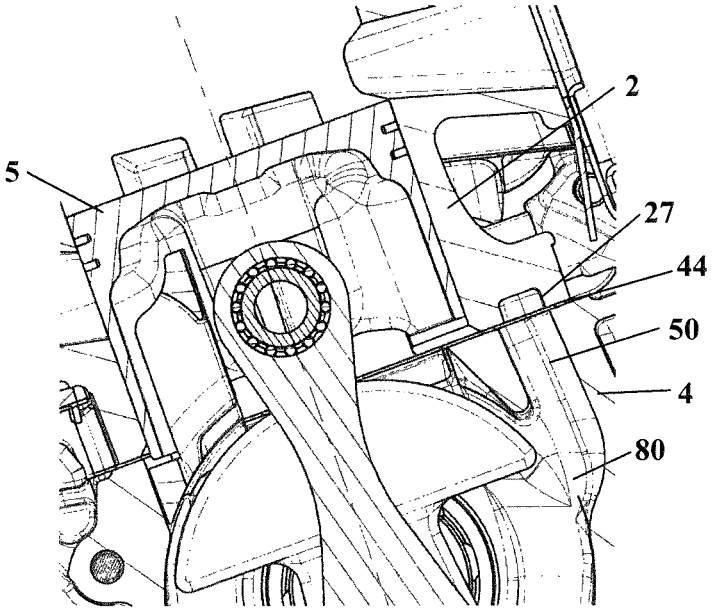

Furthermore, the connecting opening 47, through which the transfer channels 60 and 61 of a cylinder 52 can pass into the crankcase interior 20, opens out at the crankcase connecting flange 38. The connecting opening 47 is separated from the through-opening 45 by a crosspiece 48 and adjoins the channel section 50 in the wall of the crankcase 4. The connecting opening 47 has a width (d), measured perpendicularly to the central plane 28 (FIG. 3), which is less than the spacing (a) between the crankshaft bearings 36 and 37 (FIG. 3). However, the width (d) can also be greater than the spacing (a). The connecting opening 47 and the channel 50 extend entirely in the second sector 41. The crankcase connecting flange 38 has four fastening openings 55, which are aligned with the fastening openings 25 when a cylinder 2 is arranged on the crankcase 4 and are aligned with the fastening openings 75 when a cylinder 52 is arranged on the crankcase connecting flange 38. A fastening opening 82, to which a flow guide element can be secured for the targeted guidance of the combustion air flowing into the crankcase interior 20 or of the fuel/air mixture flowing in, is in each case arranged adjacent to each connecting opening 46. The through-openings 46 and 47 are arranged such that, when a cylinder 2 is arranged on the crankcase 4, the transfer channels 10 and 11 open out at the connecting openings 46 and the connecting opening 47 is closed off from the region of the cylinder connecting flange 21, which extends in the second sector 41. In this case, one of the recesses 27 is located opposite the connecting opening 47. This is shown in the sectional illustration in FIG. 7. Since the recess 27 is formed in a closed manner, the second connecting opening 47 is nevertheless closed off from the cylinder 2 toward the combustion chamber 3 in every position of the piston 5 and does not form a connection to a transfer channel.

If a cylinder 52 is mounted on the crankcase 4, the transfer opening 72 is located at the second connecting opening 47. The transfer channel section 81 in the cylinder 52 passes through the connecting opening 47 into the channel section 50 in the crankcase 4 and leads into the crankcase interior 20 via the outlet opening 80 (FIG. 4). The connecting openings 46 are closed off from the region of the cylinder flange 71 which extends in the sectors 40 and 42 and are without function. In the embodiment, the cylinder flange 71 is formed in a flat manner in the sectors 40 and 42. However, provision can also be made for recesses 27 to be provided in this region to save weight.

Since the crankcase 4 has both connecting openings 46 for connecting to transfer openings 22 of a cylinder 2 and a connecting opening 47 for connecting to the transfer opening 72 of a cylinder 52, and the cylinders (2, 52) close off the other connecting opening (46, 47) in each case, a crankcase 4 can be constructed both for cylinders 2 for forming two-stroke engines 1 and with cylinders 52 for forming two-stroke engines 51. Advantageously, precisely one connecting opening 47 is provided, which is intersected by the central plane 28. As a result, when the crankcase components 33 and 34 are produced in a casting process, the channel section 50 and the connecting opening 47 can be demolded easily with a core drawn perpendicularly to the partition plane 35. However, provision can also be made for two connecting openings 46 to be arranged symmetrically to the central plane 28, in each case two transfer channels 60 and 61 that extend on one side of the central plane 28 passing into the crankcase 4 at the connecting openings 46.

During operation of the two-stroke engines (1, 51), combustion air or fuel/air mixture is drawn into the crankcase interior 20 via the inlet opening (9, 59). During the downward stroke of the piston 5, the combustion air or the mixture is compressed in the crankcase interior 20 and, as soon as the transfer windows (14, 15, 64, 65) are opened by the downwardly traveling piston 5, flows into the combustion chamber (3, 53) via the transfer channels (10, 11, 60, 61). During the upward stroke of the piston 5, the mixture in the combustion chamber (3, 53) is compressed and is ignited by the spark plug 17 in the region of top dead center of the piston 5. On account of the subsequent combustion, the piston 5 is accelerated in the direction of the crankcase 4. As soon as the outlet opening (8, 58) is opened by the piston skirt 32 of the downwardly traveling piston 5, exhaust gases escape through the outlet opening (8, 58) and the outlet channel (18, 68), and fresh fuel/air mixture is drawn in from the crankcase interior 20. The fuel feed can take place in the inlet channel (19, 69), into the crankcase interior 20, into one or more of the transfer channels (10, 11, 60, 61) or into the combustion chamber (3, 53). The two-stroke engine (1, 51) can additionally have an air duct for scavenging air which is fed to the transfer channels (10, 11, 60, 61) and separates the fresh mixture from the crankcase interior 20 from the exhaust gases in the combustion chamber (3, 53).

It is understood that the foregoing description is that of the preferred embodiments of the invention and that various changes and modifications may be made thereto without departing from the spirit and scope of the invention as defined in the appended claims.

What is claimed is:

1. A two-stroke engine comprising: a cylinder defining a longitudinal cylinder axis and having a cylinder bore defining a combustion chamber formed therein; a piston delimiting said combustion chamber and being arranged in said cylinder so as to carry out a reciprocating back and forth movement therein between top dead center and bottom dead center; a discharge opening leading out of said combustion chamber and being controlled by said piston; a crankcase defining a crankcase interior; a crankshaft rotatably journaled in said crankcase so as to be rotatable about a crankshaft rotational axis; a connecting rod connected between said piston and said crankshaft so as to permit said piston to drive said crankshaft in rotation about said crankshaft rotational axis; at least one transfer channel configured to provide a flow connection between said crankcase interior and said combustion chamber when said piston is in a region of said bottom dead center thereof; said at least one transfer channel having a transfer window controlled by said piston; said at least one transfer channel opening into said combustion chamber via said transfer window; said crankcase having a crankcase connecting flange for connecting to said cylinder and said crankcase connecting flange defining a passthrough opening for said connecting rod; said crankcase connecting flange having at least one first connecting opening and at least one second connecting opening; said crankcase having a first fluid connection of said at least one first connecting opening with said crankcase interior and a second fluid connection of said at least one second connecting opening with said crankcase interior; said at least one first connecting opening and said at least one second connecting opening being arranged radially outside of said cylinder bore referred to said longitudinal cylinder axis; and, said at least one transfer channel passing into said crankcase at the at least one first connecting opening or at the at least one second connecting opening and, at the other one of said at least one first connecting opening and said at least one second connecting opening, there is no transfer channel passing into said crankcase.

2. The two-stroke engine of claim 1, wherein:

said two-stroke engine is dividable into four sectors running parallel to said cylinder longitudinal axis;

a first one of said sectors contains at least one of said transfer windows of at least one of said at least one transfer channels;

a second one of said sectors contains said discharge opening;

said at least one first connecting opening is arranged in said first sector; and, said at least one second connecting opening is arranged in said second sector.

3. The two-stroke engine of claim 1, wherein said passthrough opening is connected with at least one of said at least one first connecting openings.

4. The two-stroke engine of claim 3, wherein:

said crankcase connecting flange has a recess;

said at least one of said at least one first connecting openings is configured at said recess; and, said recess has a total height (h) and is open to said crankcase interior over said total height (h).

5. The two-stroke engine of claim 1, wherein said at least one second connecting opening is separated by a strut from said passthrough opening and is connected via a channel segment to said crankcase interior.

6. The two-stroke engine of claim 1, wherein said two-stroke engine defines a center plane containing said cylinder longitudinal axis; and, said center plane is arranged perpendicularly to said crankshaft rotational axis.

7. The two-stroke engine of claim 6, wherein:

there are at least two of said transfer channels and at least two of said transfer windows corresponding to respective ones of said at least two transfer channels;

said at least two transfer windows are arranged on mutually opposite sides of said center plane; and, said at least two transfer channels run symmetrically with respect to said center plane.

8. The two-stroke engine of claim 6, wherein precisely one of said at least one second connecting opening is provided and which is intersected by said center plane.

9. The two-stroke engine of claim 6, wherein said crankcase has a first crankcase component and a second crankcase component which are connected to each other on a partition plane running parallel to said center plane.

10. The two-stroke engine of claim 9, wherein said partition plane is at a distance (c) to said center plane.

11. A two-stroke engine comprising: a cylinder defining a longitudinal cylinder axis and having a cylinder bore defining a combustion chamber formed therein; a piston delimiting said combustion chamber and being arranged in said cylinder so as to carry out a reciprocating back and forth movement therein between top dead center and bottom dead center; a discharge opening leading out of said combustion chamber and being controlled by said piston; a crankcase defining a crankcase interior; a crankshaft rotatably journaled in said crankcase so as to be rotatable about a crankshaft rotational axis; a connecting rod connected between said piston and said crankshaft so as to permit said piston to drive said crankshaft in rotation about said rotational axis; at least one transfer channel configured to provide a flow connection between said crankcase interior and said combustion chamber when said piston is in the region of said bottom dead center thereof; said at least one transfer channel having a transfer window controlled by said piston; said at least one transfer channel opening into said combustion chamber via said transfer window; said crankcase having a crankcase connecting flange for connecting to said cylinder and said crankcase connecting flange defining a passthrough opening for said connecting rod; said crankcase connecting flange having at least one first connecting opening and at least one second connecting opening; said at least one first connecting opening and said at least one second connecting opening being arranged radially outside of said cylinder bore referred to said longitudinal cylinder axis; said at least one transfer channel passing into said crankcase at the at least one first connecting opening or at the at least one second connecting opening and, at the other one of said first and second connecting openings, there is no transfer channel passing into said crankcase; wherein said two-stroke engine defines a center plane containing said cylinder longitudinal axis; wherein said center plane is arranged perpendicularly to said crankshaft rotational axis; and, wherein there are two of said transfer windows arranged in a first sector; said at least one first connecting opening has a width (e) measured parallel to said center plane; said transfer windows each have a width (f, g); and, said width (e) of said at least one first connecting opening is at least 1.5 times said width (f, g) of one of said transfer windows.

12. The two-stroke engine of claim 1, further comprising first and second crankshaft bearings; said crankshaft is rotatably journaled in said crankshaft bearings; said crankshaft bearings are at a distance (a) away from each other measured parallel to said crankshaft rotational axis; said at least one second connecting opening has a width (d) measured parallel to said crankshaft rotational axis; and, said width (d) of said at least one second connecting opening is less than said distance (a) between the crankshaft bearings.

13. A production series of two-stroke engines comprising:

at least a first cylinder and at least a second cylinder;

at least one crankcase which can be assembled onto said first cylinder or onto said second cylinder;

each of said cylinders defining a cylindrical longitudinal axis and having a cylinder bore;

said first cylinder having at least one transfer channel segment which opens at a first transfer opening on a first cylinder connecting flange and at a first transfer window on the cylinder bore;

said second cylinder having at least one transfer channel segment which opens at a second transfer opening on a second cylinder connecting flange of said second cylinder and at a second transfer window on the cylinder bore;

said at least one crankcase having a crankcase connection flange;

said crankcase connection flange having at least one first connecting opening to connect to a first transfer opening of said first cylinder and at least one second connecting opening to connect to a second transfer opening of said second cylinder;

said first connecting opening and said second connecting opening being arranged to lie radially outside of the cylinder bore referred to the cylinder longitudinal axis;

said at least one crankcase having a first fluid connection of said at least one first connecting opening with said crankcase interior and a second fluid connection of said at least one second connecting opening with said crankcase interior; and, for a first two-stroke engine of the production series which has the first cylinder, the second connecting opening being closed by the first cylinder and, for a second two-stroke engine of the production series which has the second cylinder, the first connecting opening being closed by the second cylinder.

* * * * *